US005095298A

United States Patent [19]

Chapman et al.

[11] Patent Number: 5,095,298

[45] Date of Patent: Mar. 10, 1992

[54] SURFACE MOUNT VARIABLE RESISTOR WITH INSERT-MOLDED SLIDER

[75] Inventors: John B. Chapman, Rialto; Brenda K. Brunello, Riverside, both of Calif.

[73] Assignee: Bourns, Inc., Riverside, Calif.

[21] Appl. No.: 626,815

[22] Filed: Dec. 13, 1990

[51] Int. Cl.[5] ..... H01C 10/32

[52] U.S. Cl. ..... 338/162; 338/190; 338/193; 338/174; 29/610.1

[58] Field of Search ..... 338/193, 162, 190, 192, 338/174, 175; 29/610.1

[56] References Cited

U.S. PATENT DOCUMENTS

| | | | |
|---|---|---|---|
| 3,201,737 | 8/1965 | Mathison et al. | 338/174 |
| 3,456,227 | 7/1969 | Paine et al. | 338/164 |
| 3,470,519 | 9/1969 | Hatch | 338/162 |
| 3,537,056 | 10/1970 | Benthuysen et al. | 338/162 |
| 3,576,514 | 4/1971 | Michik | 338/202 |
| 3,601,743 | 8/1971 | Mathison | 338/164 |
| 3,617,978 | 11/1971 | Gerstmeier | 338/174 |
| 4,511,879 | 4/1985 | Fujii | 338/174 |
| 4,521,761 | 6/1985 | Welch | 338/174 |
| 4,812,015 | 4/1989 | Matsui et al. | 338/175 |
| 4,812,803 | 3/1989 | Hochholzer | 338/175 |
| 4,821,014 | 4/1989 | Masuda et al. | 338/164 |

FOREIGN PATENT DOCUMENTS

| | | |
|---|---|---|
| 1-37002 | 2/1989 | Japan . |
| 1-68901 | 3/1989 | Japan . |
| 2028594 | 3/1980 | United Kingdom . |

*Primary Examiner*—Marvin M. Lateef
*Attorney, Agent, or Firm*—Howard J. Klein

[57] ABSTRACT

A surface mount variable resistor includes a rotor assembly rotatably mounted on a substrate having an arcuate resistive element thereon. The rotor assembly includes a thermoplastic rotor and a conductive metal slider. The slider is a rivet having a flat head that is insert-molded into the plastic rotor, and a shank extending axially from the head, terminating in a tail end. A conductive metal wiper is welded to the head so as to be exposed from the rotor, thereby to establish electrical contact with the resistive element. A conductive metal collector element is disposed on the surface of the substrate opposite the resistive element. The substrate and the collector element have registering apertures through which the shank is inserted. The tail end of the shank is up-ended to engage the collector element, thereby (a) establishing electrical contact between the rivet and the collector element, (b) rotatably attaching the rotor assembly to the substrate, while restraining the rotor assembly from axial movement with respect to the substrate, and (c) retaining the collector element in engagement against the substrate.

18 Claims, 2 Drawing Sheets

SURFACE MOUNT VARIABLE RESISTOR WITH INSERT-MOLDED SLIDER

BACKGROUND OF THE INVENTION

This invention relates to the field of variable resistors. More particularly, it relates to variable resistors adapted for being surface mounted on a circuit board.

Surface mount variable resistors and potentiometers are well known in the art. Such devices typically are very small (miniature or subminiature, i.e., less than about 6 mm on a side), single turn devices, employing an ink film (e.g., cermet) resistive element on an insulative substrate. The resistive element is contacted by a wiper element that is mounted on the underside of a rotor that is rotatably attached to the substrate In many such devices, the wiper element is formed from a plate or slider that is disposed on the underside of the rotor, spaced from, and opposed to, the surface of the substrate on which the resistive element is carried The wiper is in the form of a finger or arm that is stamped from the slider, and bent out of the plane of the slider so as to be resiliently engageable against the resistive element Several prior art variable resistors of this general type are disclosed in U.S. Pat. No 4,821,014—Masuda et al., and in published Japanese Patent Applications Nos. 62-193025 and 62-225850.

FIG. 1 accompanying this specification illustrates a simplified version of a rotor/slider assembly 10, in accordance with the teachings of the above-referenced patent to Masuda et al. In this prior art device, a metallic slider 12, having an integral wiper arm 14 stamped therefrom, is insert-molded into a rotor 16, formed from a heat-resistant, thermoplastic resin. The slider is formed from a single metal plate having a pair of spaced-apart apertures. The plate is folded over itself with the apertures in mutual registration, forming a double-layer, substantially annular slider base, with a first, or inner, layer 12*a* lying flush against the adjoining surface of the rotor 16, and a second, or outer, layer 12*b* that partially covers the inner layer. The outer layer 12*b* has a circumferential gap defined between a pair of radial edges 12*c*, through which gap a portion of the inner layer 12*a* is exposed. The wiper arm 14 extends over the gap from one of the edges 12*c*, and is stamped out of the portion of the plate forming the outer layer 12*b*, leaving the aforementioned gap.

The use of the double layer design for the slider 12 is necessitated by the gap formed when the wiper arm 14 is stamped out of the plate from which the slider is formed. Because of this gap, a backing plate is needed during the insert molding process to shut off the mold in the area of the wiper. This backing plate function is provided by the inner layer 12*a* of the slider. Thus, one layer (the inner layer 12*a*) is needed as a backing plate or mold shut-off plate, while the other layer (the outer layer 12*b*) is needed as the wiper carrier, There are several disadvantages to the above-described arrangement. First, with an integral wiper/slider assembly, the wiper must necessarily be of the same material as the rest of the slider, thereby affording a narrower range of spring rates for the wiper than would be available by the use of different material. Second, the need to fold the plate that forms the slider, and the need to do so with sufficient precision to align the apertures, adds complexity to the fabrication process. In addition, a potential leak path is provided through the central rotor aperture (indicated by the numeral 18 in FIG. 1), between the rotor 16 and a central post (not shown) that extends through the central aperture 18, and around which the rotor 16 rotates.

Therefore, there has been a need for a surface mount variable resistor that allows for simpler construction, better sealing against leaks, and a broader range of wiper spring rates than has heretofore been possible in such devices, while maintaining the compactness of size and relative simplicity that have characterized the prior art.

SUMMARY OF THE INVENTION

Broadly, the present invention is a variable resistor, of the type having a substrate with an arcuate resistive element on a first surface thereof, a rotor disposed for rotation on the first surface of the substrate, and a slider that is insert-molded into the rotor, characterized in that the slider comprises: an annular plate embedded into the rotor so as to be spaced from, and opposed to, the first surface of the substrate; a conductive wiper welded onto the plate so as to be engageable against the resistive element; and axle means, integral with the plate and extending axially from the center thereof through the substrate, for rotatably attaching the rotor and the slider to the substrate.

More specifically, the present invention, in its preferred embodiment, employs a flat head rivet, with the head of the rivet insert molded into the rotor to provide the aforementioned plate, and with the shank of the rivet forming the axle. The wiper comprises at least one wiper arm (preferably two or more) welded to the underside of the head and extending away from the head to engage the resistive element. The substrate preferably has a conductive element (for example, a collector) on the surface opposite that which carries the resistive element, and the rivet shank (axle) extends through the substrate, with a tail that is up-ended, both to establish electrical contact with the conductive element, and to restrain the rotor/slider assembly from axial movement.

As will be more fully appreciated from the detailed description that follows, the present invention offers a number of significant advantages over the prior art. First, the use of a wiper that is welded onto the underside of the rivet head that is insert-molded into the rotor obviates the need for a double layer slider base, since there is no gap in the base plate (rivet head) for stamping out the wiper. Thus, the rivet head, lacking any such gap, provides an effective mold shut off from the wiper area during the insert molding process, while also providing a support for the wiper. In addition, the rivet, having an integral head and shank, eliminates a potential leak path between the slider base and the axle. Furthermore, the use of a separate wiper that is welded onto the slider base allows for greater control of the wiper spring rate, and a greater possible range of spring rates., through the option of a wiper made from a different material from the slider base, or from the same material but a different thickness.

DETAILED DESCRIPTION OF THE INVENTION

Figure 1:
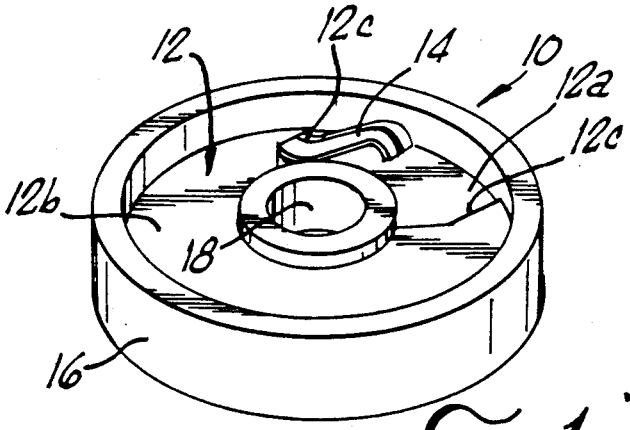
FIG. 1. PRIOR ART
FIG. 1 is a perspective view of a typical prior art rotor for a surface mount variable resistor, showing the internal, or wiper side of the rotor.
Figure 2:
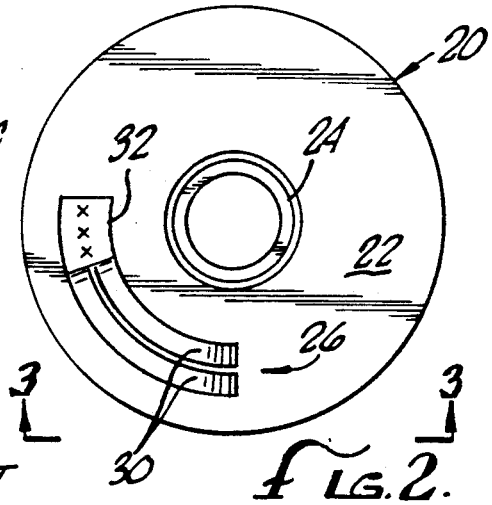
FIG. 2 is a plan view of the wiper side of a slider for a surface mount variable resistor, in accordance with a preferred embodiment of the present invention.
Figure 3:
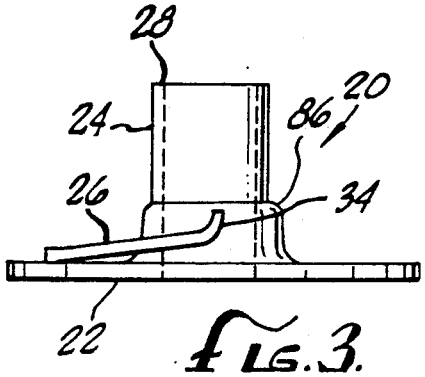
FIG. 3 is a side elevational view of the slider of FIG. 2, taken along line 3—3 of FIG. 2.

Referring first to FIGS. 2 and 3, a slider 20, in accordance with a preferred embodiment of the invention, is shown. The slider 20 is a conductive metallic element that includes an annular disc or plate that forms a slider base 22, a tubular axle 24, integral with the base 22 and extending axially from the center of the base, and a wiper 26 welded to the side of the base 22 from which the axle 24 extends. In the preferred embodiment shown, the slider 20 is formed from a 302 stainless steel flat head metal rivet, with the head of the rivet forming the base 22 and the shank of the rivet forming the axle 24. The end of the rivet shank opposite the head may be termed the "tail" 28.

The wiper 26 preferably comprises a pair of parallel arcuate wiper arms 30, each extending from a flattened pad 32 that is spot welded to the base 22. Each of the arms 30 extends from the pad 32 to a curved contact finger 34. The wiper arms 30 are made of a conductive metal, either the same material as the rivet that forms the slider 20, or a different metallic alloy, depending on the spring rate and wear characteristics desired. Many suitable metallic alloys are well known in the art, such as the precious metal alloys marketed under the trademark "PALINEY" by Ney Precious Metals. Two good examples are "PALINEY 6" (Pd-Pt-Ag-Cu) and "PALINEY 7" (Pd-Pt-Au-Ag-Cu-Zn). Also suitable are so-called "Nickel Silver" alloys (Cu-Zn-Ni). If the arms 30 are of the same material as the rivet, their thickness can be selected to achieve the desired physical characteristics.

Figure 4:
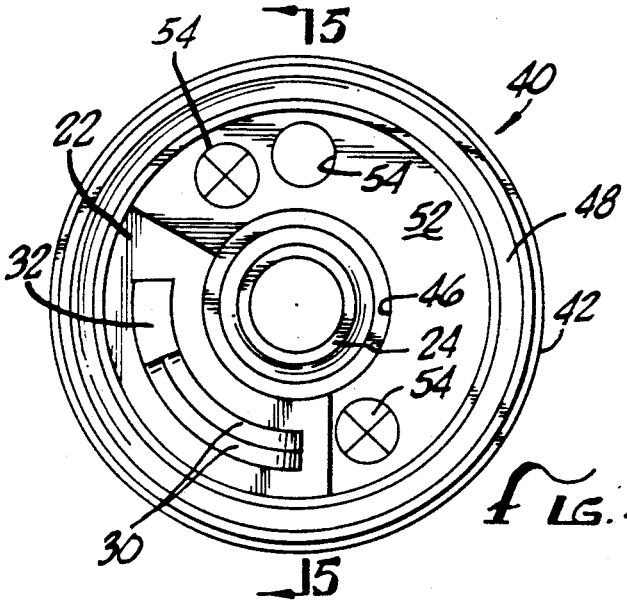
FIG. 4 is a plan view of a rotor assembly incorporating the slider of FIGS. 2 and 3, showing the internal, or wiper side of the rotor.
Figure 6:
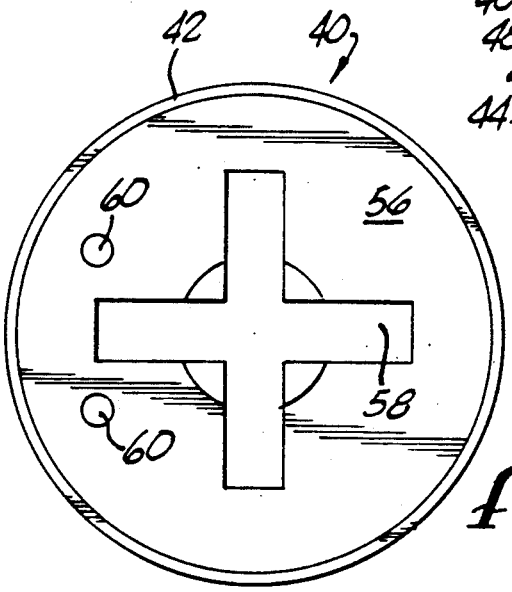
FIG. 6 Is a plan view of a rotor assembly incorporating the slider of FIGS. 2 and 3, taken along line 6—6 of FIG. 5, showing the external side of the rotor assembly.
Figure 5:
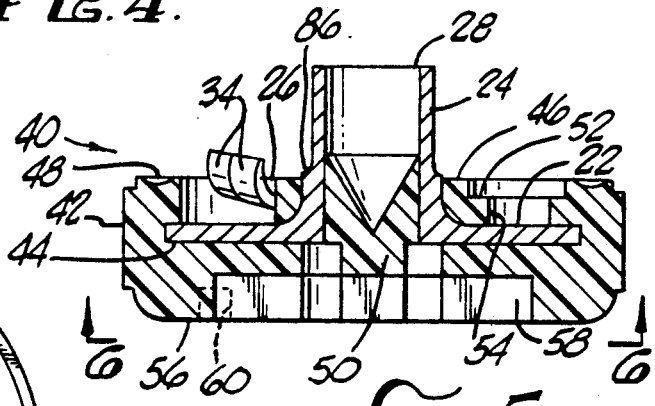
FIG. 5 is a cross-sectional view taken along line 5—5 of FIG. 4.

As shown in FIGS. 4, 5, and 6, a rotor assembly 40 is fabricated by insert molding the slider 20 into a thermoplastic rotor element 42. The rotor element 42 is a substantially discshaped member having a substantially annular first, or inner surface 44 that is defined between an inner rim 46 and an outer rim 48. The slider 20 is molded into the rotor 40 so that the slider base 22 is seated against the inner surface 44, with the axle being located between the inner rim 46 and a central plug 50. A substantial portion of the slider base is covered by an integral retainer 52, the latter being configured so as to leave exposed the portion of the slider base surrounding wiper 26, as best shown in FIG. 4. The rotor 42 is typically formed with several ejector pin holes 54, which have no effect on the function of the device, as a result of the molding process.

The rotor element has a second or external surface 56 that is formed with a cruciform slot 58 for receiving a tool (not shown) for rotating the rotor assembly. Advantageously molded into the external surface on either side of one arm of the slot is a pair of locator holes 60, for centering the rotor assembly 40 with respect to the resistive element, as will be described below.

Figure 7:
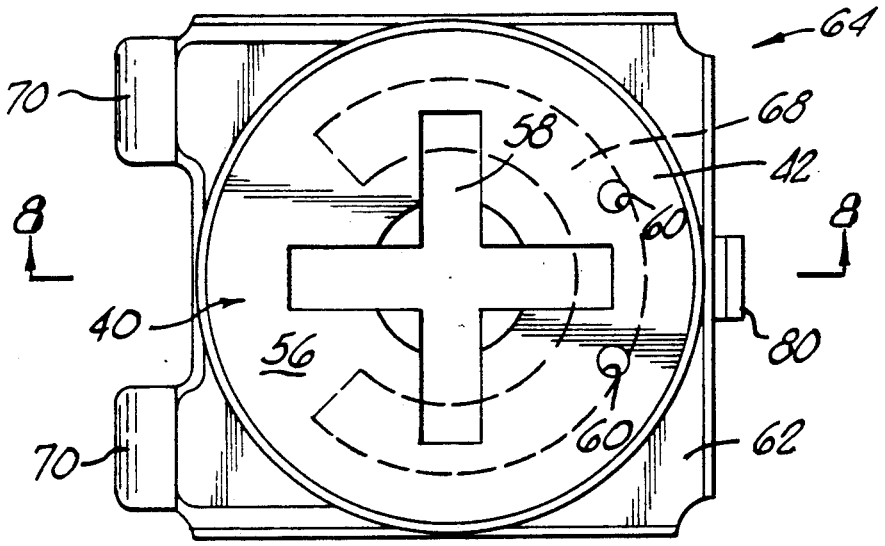
FIG. 7 is a top plan view of a surface mount variable resistor, in accordance with a preferred embodiment of the invention, incorporating the rotor assembly of FIGS. 4, 5, and 6.
Figure 8:
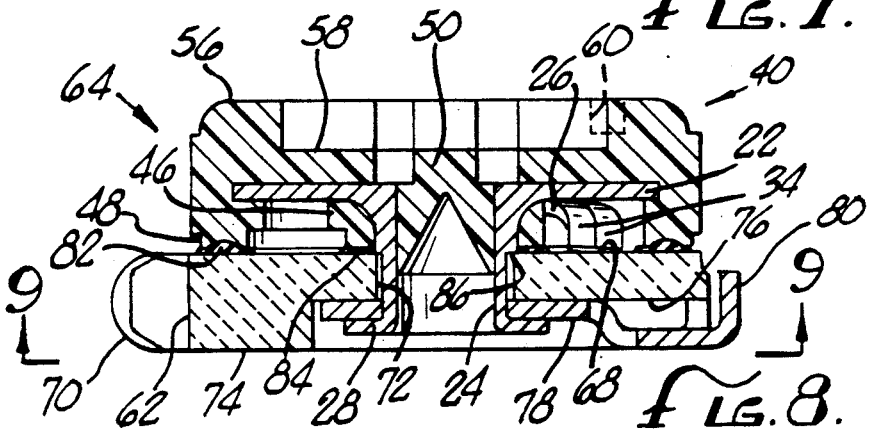
FIG. 8 is a cross-sectional view taken along line 8—8 of FIG. 7.

Referring now to FIGS. 7 and 8, the rotor assembly 40 is shown mounted on a substrate 62 to form a surface mount variable resistor 64. The substrate 62 has a first or inner surface, on which is printed an arcuate, ink film resistive element 68, formed, for example, from a cermet ink, as is well known in the art. As is conventional in the art, conductive traces (not shown) on the inner surface of the substrate electrically connect each end of the resistive element to a conductive metallic terminal pad 70.

Figure 9:
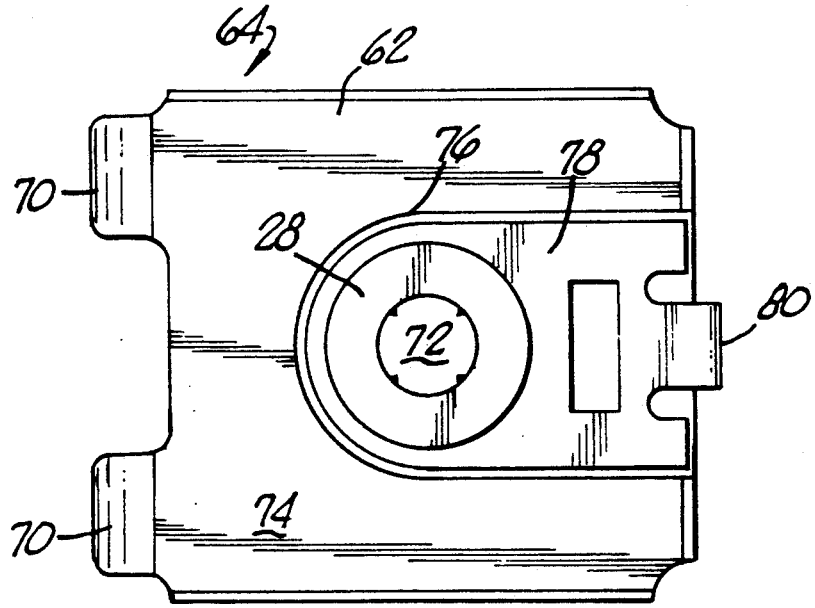
FIG. 9 is a bottom plan view of the variable resistor of FIGS. 7 and 8.

As shown in FIG. 9 the substrate 62 has a central aperture 72 that receives the shank of the slider rivet that forms the slider axle 24. The aperture 72 extends through the substrate 62 to the opposite or outer surface 74 that is formed with a recess 76 that receives a conductive collector plate 78. The collector plate 78 extends toward the edge of the substrate, terminating in a collector terminal 80. An aperture in the collector plate 78 registers with the substrate aperture 72, so that the tail end 28 of the slider axle 24 can extend through the collector plate 78.

To mount the rotor assembly 40 rotatably onto the substrate 62, the axle 24 is inserted into the substrate aperture 72, so that the tail end 28 of the axle 24 extends through the collector plate aperture. The tail end is then up-ended, as shown in FIG. 8, to engage the collector plate 78, thereby restraining the rotor assembly 40 from axial movement with respect to the substrate, while allowing the rotor assembly 40 to rotate with respect to the substrate. In addition, the up-ended tail 28 locks the collector plate 78 in place against the substrate, while establishing electrical contact between the slider 20 and the collector plate 78.

An outer hermetic seal 82, preferably of a silicone or a fluorosilicone compound, is advantageously provided between the rotor outer rim 48 and the substrate 62. A similar inner hermetic seal 84 is provided between the rotor inner rim 46 and the substrate 62. The shank of the slider rivet has a peripheral shoulder 86 (as best seen in FIGS. 3 and 5) that forms a seating surface for the inner seal 84, thereby enhancing the seal's integrity.

From the foregoing description, it can be seen that the present invention offers significant advantages over the prior art. For example, because the wiper is welded onto the slider base plate, rather than stamped out of it, a single thickness base plate can be used both as a carrier for the wiper, and as a means for shutting off the mold in the area of the wiper during the molding process. In addition, because the rivet provides an integral axle and base plate unit, there can be no leak path between the axle and the base plate, as can exist if these two elements were separate. Furthermore, the rivet provides good structural integrity and strength for the rotor assembly. Still another advantage is the greater range of available wiper spring rates, due to the use of a separate wiper that can be made of a different material from that of the slider base plate, or a different thickness of the same material. Overall, the present invention affords relative simplicity and economy of manufacture, while providing a variable resistor that can be made very compact (e.g., approximately 4 mm square), with excellent sealing characteristics.

While a preferred embodiment of the invention has been described herein, it will be apparent that a number of variations and modifications may occur to those skilled in the pertinent arts. For example, the configuration of the wiper can take a number of forms, depending upon the application. Also, the present invention can readily be adapted to lead-type, as well as surface mount, components. These and other variations and modifications should be considered within the spirit and scope of the invention, as defined in the claims that follow.

What is claimed is:

1. In a variable resistor, of the type including a substrate having a first surface with an arcuate resistive element thereon and a second surface opposed to the first substrate surface, and a rotor rotatably mounted on the substrate so as to have an inner surface opposed to the first substrate surface, the improvement comprising:

a conductive element on the second substrate surface;

an annular plate seated in the rotor so as to be seated against the inner surface of the rotor;

a conductive wiper attached to the annular plate so as to establish electrical contact with the resistive element; and axle means, formed integrally with the plate and extending axially from the center of the plate and through the substrate so as to establish electrical contact with the conductive element on the second substrate surface, for rotatably mounting the rotor and the plate onto the substrate.

2. The variable resistor of claim 1, wherein the plate and axle means are formed from a first conductive metallic material, and the wiper is formed from a second conductive metallic material.

3. The variable resistor of claim 1, wherein the plate and the axle means are formed from a rivet having a head and a shank, the head of the rivet forming the plate, and the shank of the rivet forming the axle means, the shank of the rivet having a tail end that extends through the second surface of the substrate and that is up-ended against the conductive element to restrain the rotor from axial movement with respect to the substrate.

4. The variable resistor of claim 3, wherein the up-ended tail end of the rivet shank establishes electrical contact with the conductive element.

5. A variable resistor, comprising:

a substrate having a first surface and a second surface, the surface having an arcuate resistive element thereon, and the second surface having a conductive element thereon;

a rotor;

slider means, having an annular portion embedded in the rotor, and an integral axial portion extending through the substrate to establish electrical contact with the conductive element on the second surface of the substrate, for rotatably mounting the rotor onto the first surface of the substrate; and wiper means, welded onto the annular portion of the slider means, for establishing electrical contact with the resistive element.

6. The variable resistor of claim 5, wherein the slider means is formed from a first conductive metallic material, and the wiper means is formed from a second conductive metallic material.

7. The variable resistor of claim 5, wherein the slider means comprises:

a tubular member extending through the substrate, the tubular member having first and second ends, the first end being formed as an annular plate having a first surface spaced from and opposed to the first surface of the substrate, the wiper means being welded to the first surface of the plate, the second end of the tubular member being configured so as to engage the conductive element on the second surface of the substrate.

8. The variable resistor of claim 7, wherein the tubular member is a rivet having a head and a shank, the head forming the annular plate, the second end of the tubular member being a tail end that is up-ended to engage the conductive element.

9. The variable resistor of claim 8, wherein the up-ended tail end restrains the rotor from axial movement with respect to the substrate.

10. A variable resistor, comprising:

a substrate having a first surface with an arcuate resistive element thereon, and a second surface opposed to the first surface;

a conductive element on the second substrate surface;

a rotor of molded plastic material disposed on the first surface of the substrate;

conductive metal slider means, having a first end with an integral annular plate embedded in the rotor, and extending axially from the plate through the substrate to a second end rotatably engaging the conductive element, for (a) rotatably attaching the rotor to the substrate, (b) restraining the rotor from axial movement with respect to the substrate, and (c) retaining the conductive element against the substrate; and a conductive metal wiper attached to the plate so as to extend from the rotor to establish electrical contact with the resistive element.

11. The variable resistor of claim 10, wherein the slider means is formed from a first conductive metallic material, and the wiper is formed from a second conductive metallic material.

12. The variable resistor of claim 10, wherein the slider means comprises:

a rivet having a substantially flat, annular head forming the plate of the slider means, the rivet having a shank extending axially from the head through the substrate and through the conductive element and terminating in the second end.

13. The variable resistor of claim 12, wherein the substrate and the conductive element have apertures in registration through which the shank extends.

14. The variable resistor of claim 12, wherein the second end of the shank is up-ended to engage the conductive element so as to establish electrical contact therewith

15. A method of manufacturing a variable resistor, comprising the steps of:

providing a conductive metal rivet having a substantially flat head and a shank with a tail end extending axially from a first side of the head;

welding a conductive metal wiper to the first side of the head;

molding the rivet into a thermoplastic rotor to form a rotor assembly, wherein the shank provides a rotor axle, and wherein the rivet head provides a mold shut off in the area of the wiper, so as to leave the wiper exposed from the rotor;

providing an insulative substrate with an ink resistive element printed on a first surface thereof; and rotatably mounting the rotor assembly on the first surface of the substrate, so as to establish electrical contact between the wiper and the resistive element.

16. The method of claim 15, wherein the substrate is provided with an aperture dimensioned to receive the shank, and wherein the mounting step comprises the steps of:

inserting the shank through the aperture; and up-ending the tail end of the shank back toward the substrate so as to restrain the rotor assembly from axial movement with respect to the substrate.

17. The method of claim 16, further comprising the step of providing a conductive element on the surface of the substrate opposite the resistive element, the conductive element having an aperture in registration with the aperture in the substrate, wherein the mounting step comprises the steps of:

inserting the tail end of the shank through the apertures in the substrate and the conductive element; and up-ending the tail end of the shank so as to establish electrical contact between the tail end and the conductive element.

18. The method of claim 15, wherein the rivet and the are formed from different conductive metallic materials.

* * * * *